US009926795B2

(12) United States Patent
Kurz

(10) Patent No.: US 9,926,795 B2
(45) Date of Patent: Mar. 27, 2018

(54) FAN BLADE POSITIONING AND SUPPORT SYSTEM FOR VARIABLE PITCH, SPHERICAL TIP FAN BLADE ENGINES

(71) Applicant: UNITED TECHNOLOGIES CORPORATION, Farmington, CT (US)

(72) Inventor: Leslie Charles Kurz, Hebron, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 306 days.

(21) Appl. No.: 14/682,786

(22) Filed: Apr. 9, 2015

(65) Prior Publication Data

US 2015/0354378 A1 Dec. 10, 2015

Related U.S. Application Data

(60) Provisional application No. 62/008,953, filed on Jun. 6, 2014.

(51) Int. Cl.
*F01D 5/30* (2006.01)
*F01D 5/32* (2006.01)
(Continued)

(52) U.S. Cl.
CPC ..... *F01D 5/3007* (2013.01); *F01D 5/02* (2013.01); *F01D 5/16* (2013.01); *F01D 5/26* (2013.01);
(Continued)

(58) Field of Classification Search
CPC ..... F01D 5/3007; F01D 5/3038; F01D 5/282; F01D 5/02; F01D 5/16; F01D 5/26;
(Continued)

(56) References Cited

U.S. PATENT DOCUMENTS 5,015,150 A * 5/1991 Rohra ..... B64C 11/06 416/207
RE33,954 E * 6/1992 Honda ..... F01D 5/3007 416/196 R
(Continued)

FOREIGN PATENT DOCUMENTS

EP 0971096 A2 1/2000
EP 1312756 A2 5/2003

OTHER PUBLICATIONS

European Search Report for EP Application No. 15 00 1691.
European Office Action dated Dec. 20, 2017 for Application No. 15001691.3.

*Primary Examiner* — Christopher Verdier
(74) *Attorney, Agent, or Firm* — Cantor Colburn LLP

(57) ABSTRACT

The present disclosure provides a blade positioning and support system for a gas turbine engine including a blade, the blade having a root and a tip, with the root having a surface oriented away from the tip, the surface having a forward end and an aft end, the forward end projecting farther away from the tip than the aft end. Further, the present disclosure provides a blade receiver, the blade receiver having a face and a facet, with the face being oriented away from the facet, the face having a forward end and an aft end, the aft end projecting farther away from the facet than the forward end.

20 Claims, 9 Drawing Sheets

(51) Int. Cl.

| | |
|---|---|
| ***F01D 5/02*** | (2006.01) |
| ***F01D 5/26*** | (2006.01) |
| ***F01D 17/10*** | (2006.01) |
| ***F04D 29/36*** | (2006.01) |
| ***F04D 29/34*** | (2006.01) |
| ***F04D 29/38*** | (2006.01) |
| ***F01D 5/16*** | (2006.01) |

(52) U.S. Cl.
CPC ..... *F01D 17/10* (2013.01); *F04D 29/34* (2013.01); *F04D 29/362* (2013.01); *F04D 29/38* (2013.01); *F05D 2220/32* (2013.01); *F05D 2230/60* (2013.01); *Y10T 29/49323* (2015.01)

(58) Field of Classification Search
CPC ..... F01D 5/325; F01D 5/326; F01D 17/10; F01D 29/34; F01D 29/38; F01D 29/322; F01D 5/323; F05D 2220/32; F05D 2220/60; F04D 29/322; F04D 29/34; F04D 29/36; F04D 29/362
USPC ..... 416/219 R, 220 R, 221
See application file for complete search history.

(56) References Cited

U.S. PATENT DOCUMENTS

| | | | | |
|---|---|---|---|---|
| 5,860,787 | A | 1/1999 | Richards | |
| 5,913,660 | A * | 6/1999 | Knott | F01D 5/30 416/219 R |
| 6,059,533 | A * | 5/2000 | Stoker | C23C 4/02 415/119 |
| 6,739,837 | B2 * | 5/2004 | Barnette | F01D 5/3092 416/219 R |
| 6,764,282 | B2 * | 7/2004 | Suciu | F01D 5/141 416/220 R |
| 7,374,403 | B2 * | 5/2008 | Decker | F01D 5/141 416/223 A |
| 7,442,007 | B2 * | 10/2008 | Bibor | F01D 5/3007 416/193 A |
| 8,568,101 | B2 * | 10/2013 | Fujimura | F01D 5/3007 416/204 A |
| 2010/0034659 | A1 | 2/2010 | Fujimura | |

* cited by examiner

FAN BLADE POSITIONING AND SUPPORT SYSTEM FOR VARIABLE PITCH, SPHERICAL TIP FAN BLADE ENGINES

CROSS-REFERENCE TO RELATED APPLICATION

This Application is a non-provisional patent application claiming priority under 35 USC § 119(e) to U.S. Provisional Patent Application Ser. No. 62/008,953 filed on Jun. 6, 2014.

FIELD OF THE DISCLOSURE

The subject matter of the present disclosure relates generally to gas turbine engines and, more particularly, to blades and blade receivers for gas turbine engines.

BACKGROUND OF THE DISCLOSURE

Many modern aircraft employ gas turbine engines for propulsion. Such engines include a fan, compressor, combustor and turbine provided in serial fashion, forming an engine core, and arranged along a central longitudinal axis. Air enters the engine through the fan and is pressurized in the compressor. This pressurized air is mixed with fuel in the combustor. The fuel-air mixture is then ignited, generating hot combustion gases that flow downstream to the turbine. The turbine is driven by the exhaust gases and mechanically powers the compressor and fan via an internal shaft. Energy from the combustion gases not used by the turbine is discharged through an exhaust nozzle, producing thrust to power the aircraft.

Turbofan engines contain an engine core and fan surrounded by a fan cowl, forming part of the nacelle. The nacelle is a housing that contains the engine. The fan is positioned forward of the engine core and within the fan cowl. The engine core is surrounded by an engine core cowl and the area between the fan cowl and the engine core cowl is functionally defined as the fan duct. This fan duct is substantially annular in shape to accommodate the airflow from the fan and around the engine core cowl. The airflow through the fan duct, known as bypass air, travels the length of the fan duct and exits at the aft end of the fan duct at a fan nozzle. The fan nozzle is comprised of an engine core cowl disposed within a fan cowl and is located at the aft portion of the fan duct.

In addition to thrust generated by combustion gasses, the fan of turbofan jet turbine engines also produces thrust by accelerating and discharging ambient air through the fan exhaust nozzle. The fan includes a plurality of blades mounted to a central hub. Each blade includes a tip, distal to the central hub, in close proximity to a rub strip along the nacelle interior. The rub strip is a section of the nacelle interior closest to the tip. In a variable-pitch design, the angle of the blades may be adjusted relative to the rub strip to provide multiple propulsion modes. Individual blades are inserted into blade receivers that can adjust the blade angle. As the blade angle changes, the tip rotates relative to the rub strip.

To maintain a desired amount of clearance between the blade and the rub strip while allowing a variable-pitch design, both the tip and the rub strip may be spherically shaped. However, as a rub strip may have a leading edge with a smaller inner diameter than that of a rub strip center section, it may be impossible to insert the blade into the blade receiver axially along the central longitudinal axis, as the tip will not clear the rub strip leading edge.

Accordingly, there is a need for an improved blade positioning and support system.

SUMMARY OF THE DISCLOSURE

To meet the needs described above and others, the present disclosure provides a blade positioning and support system for a gas turbine engine including a blade having a root and tip, with the root having a surface that may be oriented away from the tip, the surface having a forward end and an aft end, the forward end may project farther away from the tip than the aft end. The blade positioning and support system may further include a blade receiver having a face and a facet, the face may be oriented away from the facet, the face having a forward end and an aft end, the aft end may project farther away from the facet than the forward end.

The face may project at a plurality of distances from the facet.

The surface may project at a plurality of distances from the tip.

The blade can be inserted into the blade receiver while passing within a leading edge of a rub strip, and the blade receiver may have the ability to alter the blade pitch angle continuously, or in step changes, and to provide thrust in multiple directions.

The blade receiver may include multiple blade positions along an axis between the tip and the root as the blade is inserted into the blade receiver.

The blade receiver may support the blade along the axis between the tip and the root after the blade is inserted into the blade receiver.

The blade may consist of a main blade body section and a root section.

The blade receiver may consist of a main blade receiver body section and a blade receiver section.

The tip and rub strip may be generally spherically shaped.

The blade or blade receiver may include a material having dampening properties, such as a polymer, metal alloy or ceramic, to dampen vibrations in certain modes of operation.

The present disclosure also provides a gas turbine engine including a fan having a plurality of blade, at least one of the blades having a root and tip, with the root having a surface that may be oriented away from the tip, the surface having a forward end and an aft end, the forward end may project farther away from the tip than the aft end. The blade positioning and support system may further include a plurality of blade receivers having a face and a facet, the face may be oriented away from the facet, the face having a forward end and an aft end, the aft end may project farther away from the facet than the forward end.

The face may project at a plurality of distances from the facet.

The surface may project at a plurality of distances from the tip.

The blade of the gas turbine engine can be inserted into the blade receiver while passing within a leading edge of a rub strip, and the blade receiver may have the ability to alter the blade pitch angle continuously, or in step changes, and to provide thrust in multiple directions.

The blade receiver may include multiple blade positions along an axis between the tip and the root as the blade is inserted into the blade receiver.

The blade receiver may support the blade along the axis between the tip and the root after the blade is inserted into the blade receiver.

The blade of the gas turbine engine may consist of a main blade body section and a root section.

The blade receiver of the gas turbine engine may consist of a main blade receiver body section and a blade receiver section.

The tip and rub strip may be generally spherically shaped.

The present disclosure further provides a method of positioning and supporting a blade in a blade receiver, which may include providing a blade, the blade having a root and a tip, with the root having a surface oriented away from the tip, the surface having a forward end and an aft end, contouring the surface so as to have the forward end projecting farther away from the tip than the aft end, providing a blade receiver, the blade receiver having a face and a facet, with the face being oriented away from the facet, the face having a forward end and an aft end, contouring the face so as to have the aft end projecting farther away from the facet than the forward end and inserting the blade into the blade receiver.

BRIEF DESCRIPTION OF THE DRAWINGS

For further understanding of the disclosed concepts and embodiments, reference may be made to the following detailed description, read in connection with the drawings, wherein like elements are numbered alike, and in which.

It is to be noted that the appended drawings illustrate only typical embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION OF THE DRAWINGS

Figure 1:
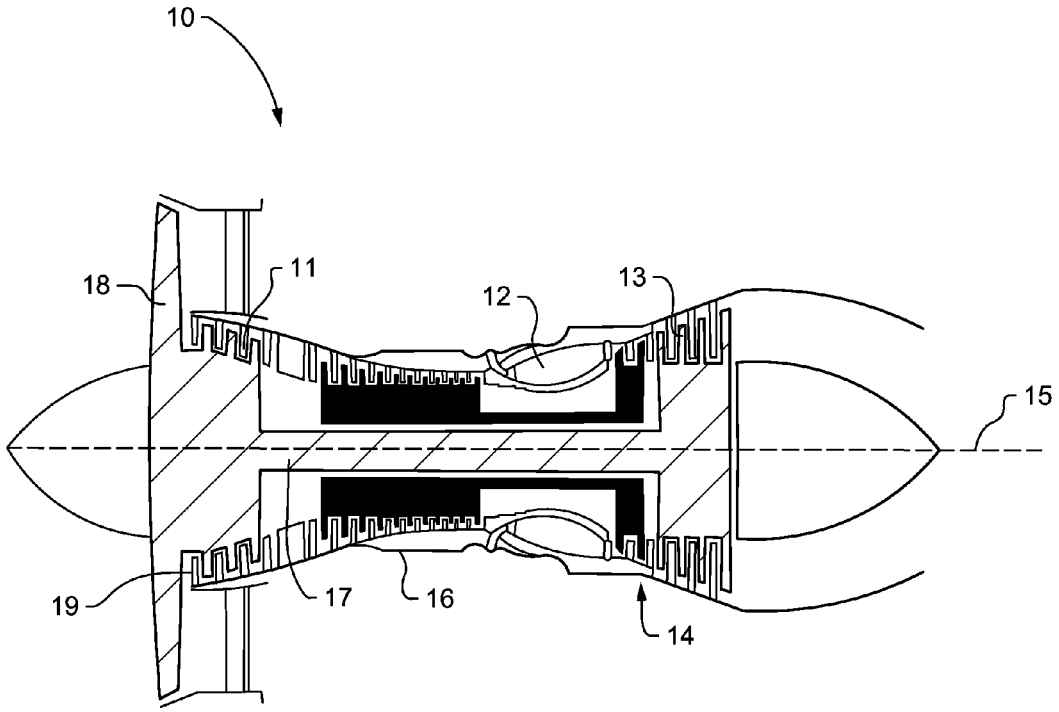
FIG. 1 is a sectional view of a gas turbine engine.

Turning now to the drawings, and with specific reference to FIG. 1, a gas turbine engine constructed in accordance with the present disclosure is generally referenced to by reference numeral 10. The gas turbine engine 10 includes a compressor 11, combustor 12 and turbine 13, known as the engine core 14, lying along a central longitudinal axis 15, and surrounded by an engine core cowl 16. The compressor 11 is connected to the turbine 13 via a central rotating shaft 17. Additionally, in a typical multi-spool design, plural turbine 13 sections are connected to, and drive, corresponding ones of plural sections of the compressor 11 and a fan 18, enabling increased compression efficiency.

As is well known in the art, ambient air enters the compressor 11 at an inlet 19, is pressurized, and is then directed to the combustor 12, mixed with fuel and combusted. This generates combustion gases that flow downstream to the turbine 13, which extracts kinetic energy from the exhausted combustion gases. The turbine 13, via shaft 17, rotatingly drives the compressor 11 and the fan 18, which draws in ambient air.

Figure 2:
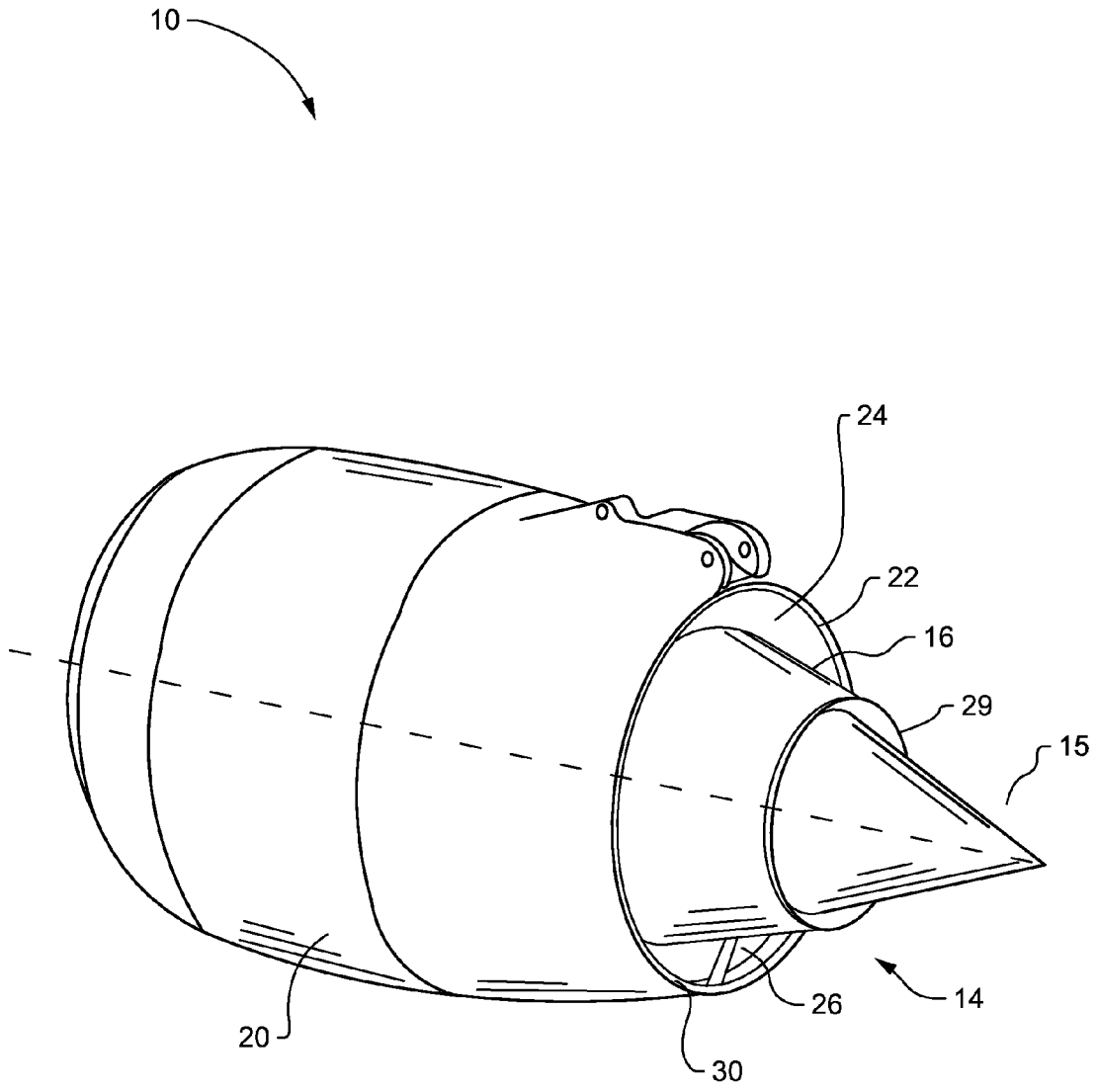
FIG. 2 is a rear perspective view of a gas turbine engine.

A nacelle 20 is a substantially cylindrical housing around the gas turbine engine 10. As best understood through FIG. 2 in conjunction with FIG. 7, the interior surface of nacelle 20 consists of a fan cowl 22, which surrounds the fan 18 and engine core cowl 16. A fan duct 24 is functionally defined by the axially extending area between the engine core cowl 16 and the fan cowl 22. The fan duct 24 is substantially annular in shape to accommodate the airflow produced by the fan 18. This airflow travels the length of the fan duct 24 and exits downstream at a fan nozzle 26. Thrust is produced both by the ambient air accelerated aft by the fan 18 through the fan duct 24 and by exhaust gasses exiting from the engine core 14. The fan nozzle 26 is located at the downstream exit of the fan duct 24. The fan nozzle 26 shape is defined by the axially extending area between the engine core cowl trailing rim 29 and the nacelle trailing rim 30.

Figure 3:
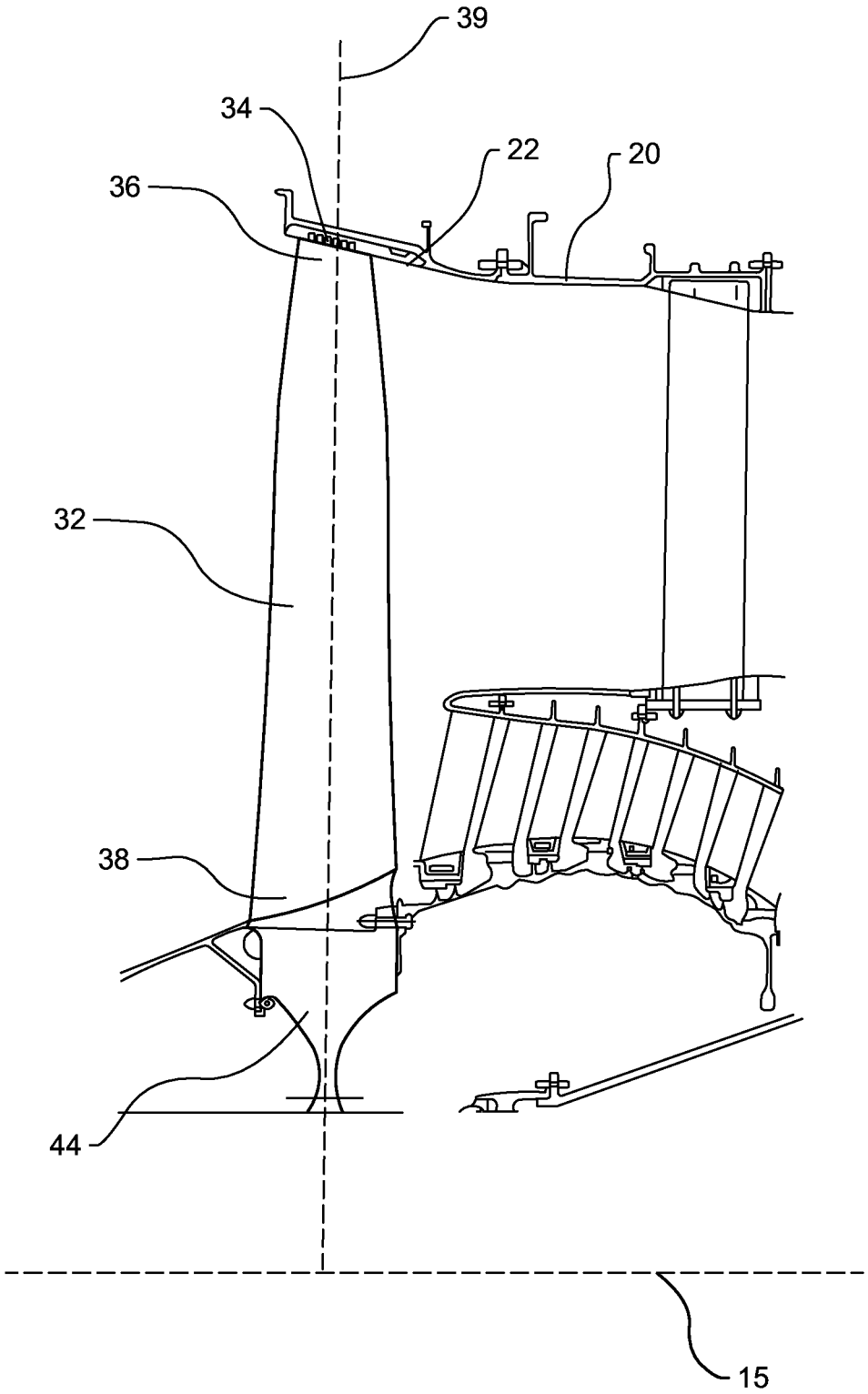
FIG. 3 is a sectional view of the forward section of a gas turbine engine.

The fan 18 may include a plurality of blades 32 radially extending from the central longitudinal axis 15, as best shown in FIG. 3. As will be seen, blades 32 are disposed within the nacelle 20 and rotate relative thereto in close proximity. More specifically, each blade 32 includes a tip 36 which rotates against a rub strip 34 lining the fan cowl 22. Each blade 32 also includes a root 38 located between the tip 36 and the central longitudinal axis 15. Further, a blade axis 39 runs between the tip 36 and the root 38.

Figure 4:
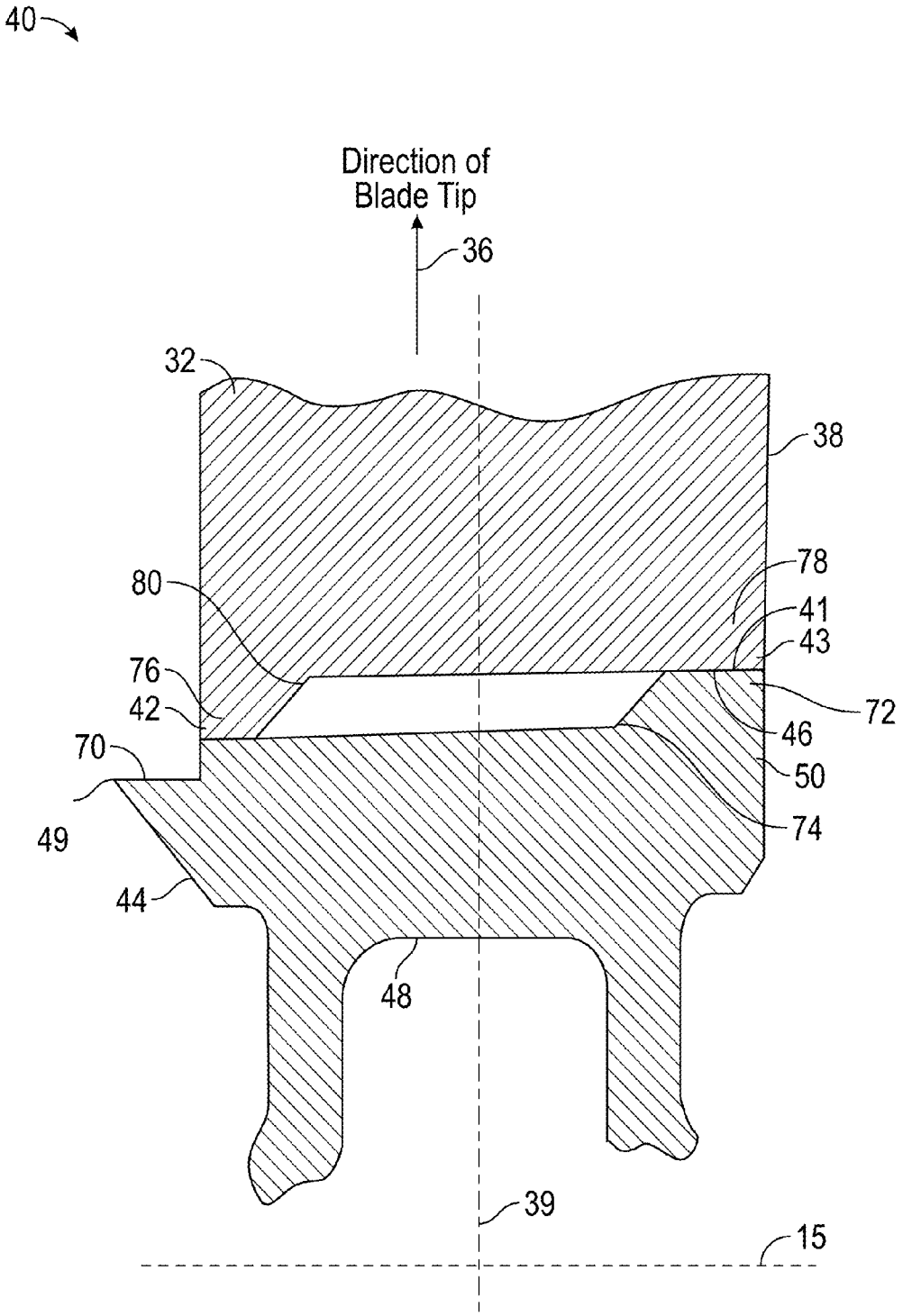
FIG. 4 is an enlarged sectional view of a blade receiver and root according to the present disclosure.

A blade positioning and support system 40 according to the present disclosure teaches each root 38 having a surface 41 including a forward end 42 and an aft end 43, as best shown in FIG. 4. The blade positioning and support system 40 further includes a plurality of blade receivers 44, each operatively designed to axially accept blade 32 at a different radius from the central longitudinal axis 15 than the radius of blade 32 after its complete installation in receiver 44.

Each blade receiver 44 has a face 46 and a facet 48, and each face 46 further includes a forward end 49 and an aft end 50. Each face 46 is oriented away from each facet 48, aligning the face 46 with the surface 41 and allowing operative communication between the face 46 and the surface 41. The aft end 50 of the face 46 projects farther from the facet 48 than the forward end 49 of the face 46, creating multiple face 46 radii from the central longitudinal axis 15 when the blade receiver 44 is positioned with the facet 48 turned towards the central longitudinal axis 15, as shown in FIG. 4. In one embodiment, the blade receiver face has a first portion 70 extending axially from a leading edge of the blade receiver at its forward end and a second portion 72 at its aft end, the second portion being spaced further from the facet than the first portion and the first portion being connected to the second portion by an angled ramp 74. The blade root surface also having a first surface portion 76 at its forward end and a second surface portion 78 at its aft end, the first surface portion being spaced from the tip further than the second surface portion and being connected to the second surface portion by an angled ramp 80; and wherein the first surface portion of the blade root surface is received on the first portion of the blade receiver face and the second surface portion of the blade root surface is received on the second portion of the blade receiver face when the blade is installed in the blade receiver.

The surface 41 is oriented away from the tip 36, as shown by blade axis 39, aligning the surface 41 with the face 46 and allowing operative communication between the surface 41 and the face 46. A forward end 42 of the surface 41 projects farther from the tip 36 than an aft end 43 of the surface 41. As the blade 32 is inserted into the blade receiver 44, the blade may positionally translate in the direction of the tip 36 along the blade axis 39, allowing an initial axial blade 32 insertion at a smaller radius from the central longitudinal axis 15 than that of a fully inserted blade 32.

The blade 32 or blade receiver 44 may include a material having damping properties, such as, but not limited to, a polymer, metal alloy or ceramic, to dampen vibrations in certain modes of operation. These modes could include sustained operation at a high or low RPM, and rapid angular acceleration between different RPMs.

Figure 5:
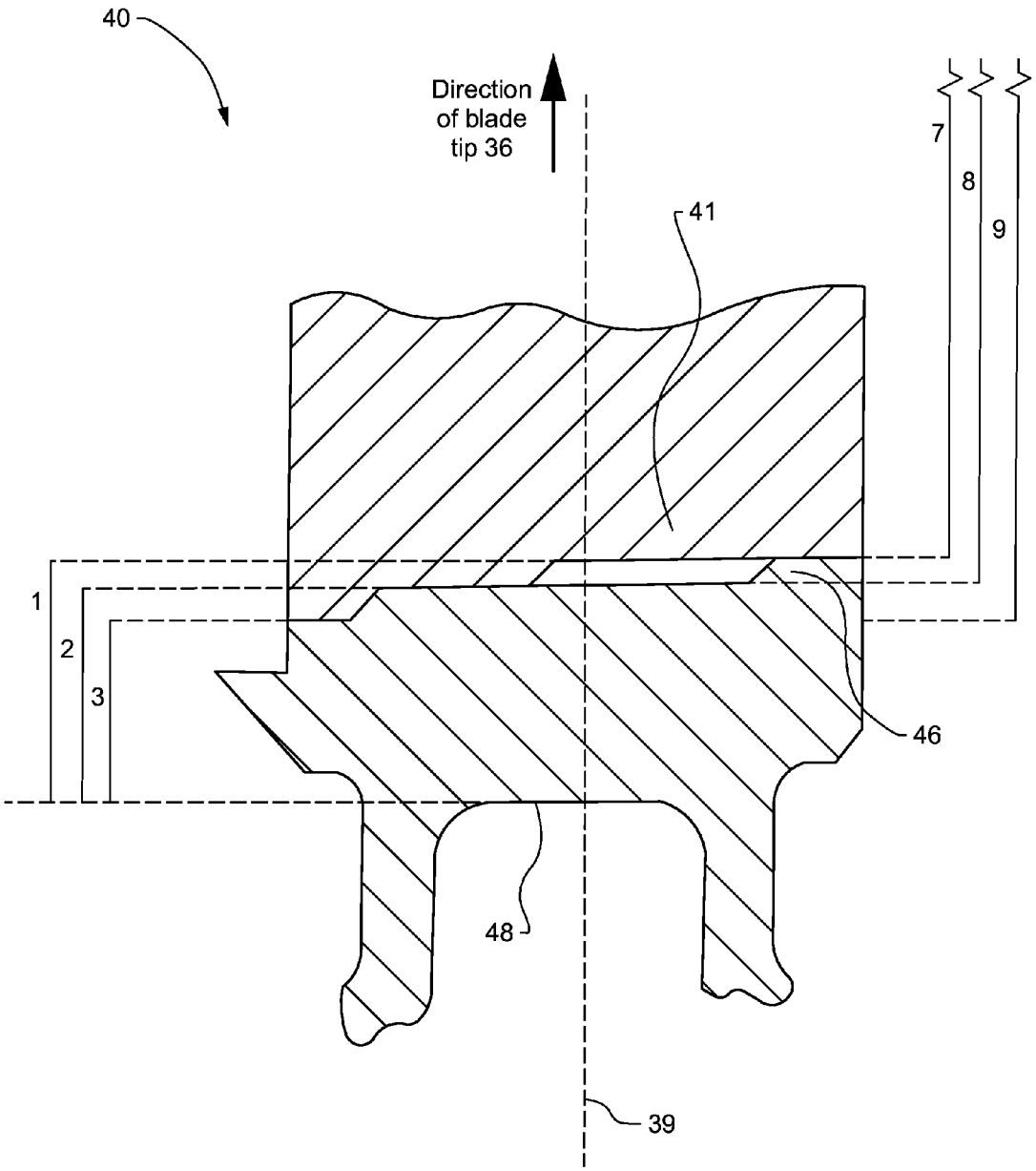
FIG. 5 is an enlarged sectional view of a blade receiver and root similar to FIG. 3, but depicting alternate embodiments of a blade receiver and a root.

In an alternate embodiment, the face 46 may project at a plurality of distances from the facet 48 along the blade axis 39, as shown best in FIG. 5. For example, three such distances are shown in FIG. 5 as distances 1, 2 and 3. Similarly, the surface 41 may project at a plurality of distances from the tip 36. Example distances 7, 8 and 9 are shown in FIG. 5. In this embodiment, the interaction between the face 46 and the surface 41, as they slide in opposite directions in contact with one another, causes the blade 32 to progressively translate along the blade axis 39 with multiple radial translations.

Figure 6:
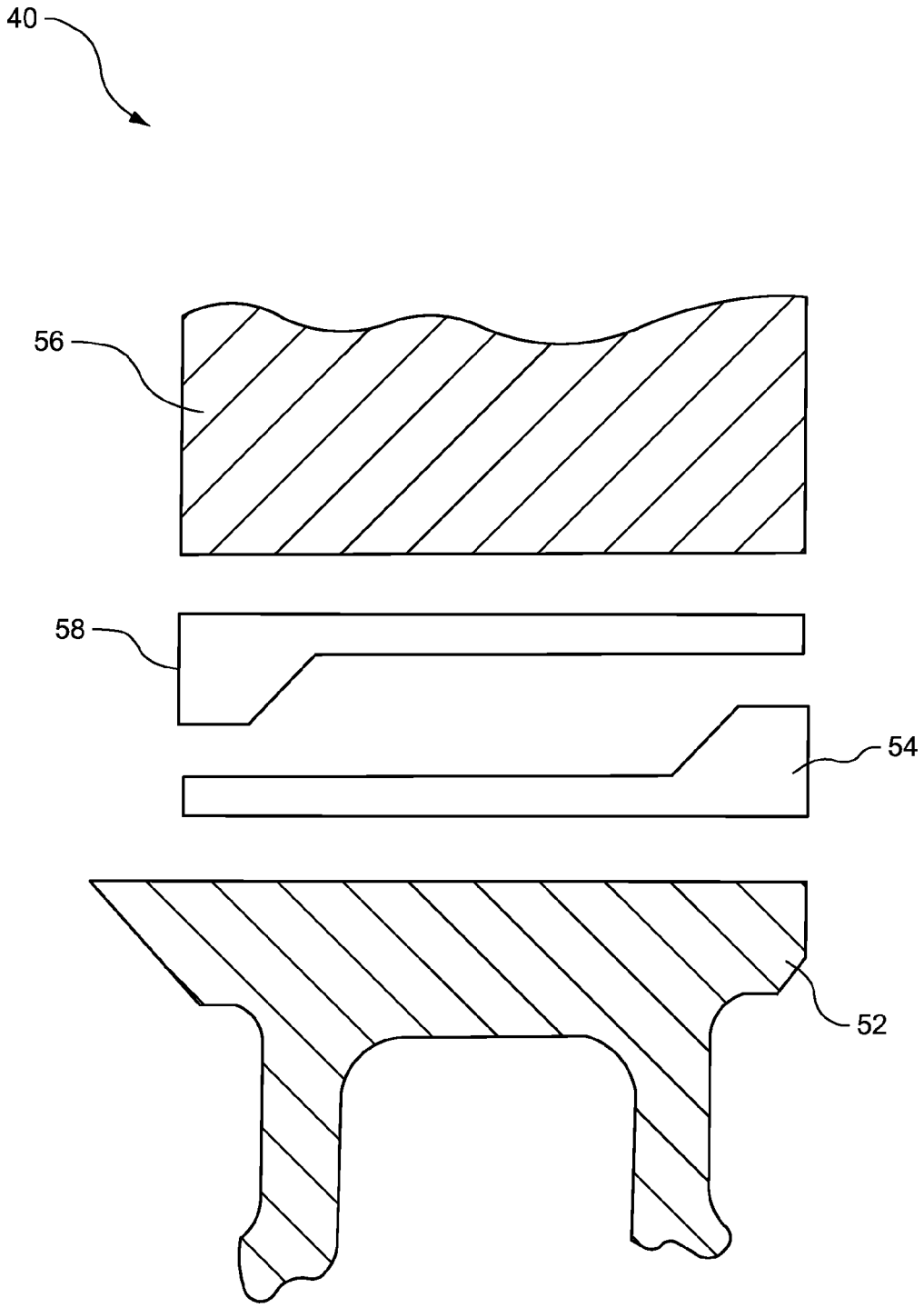
FIG. 6 is an enlarged sectional view of a blade receiver and root similar to FIG. 3 but depicting a root and a blade receiver according to another embodiment, each consisting of multiple sections.

In an additional embodiment, the blade receiver 44 may be composed of two sections, including a main blade receiver body 52 and a blade receiver section 54, as best shown in FIG. 6. Further, the blade 32 may be composed of two sections, a main blade body section 56 and a root section 58, also shown in FIG. 6. These distinct blade 32 and blade receiver 44 constituent parts may serve to ease costs and complexities of production, transportation or installation of the aforementioned elements. Further, distinct blade receiver sections 54 and root sections 58 may allow the blade positioning and support system 40 according to the present disclosure to be retrofitted into existing gas turbine engines.

Tip 36 rotates in close proximity with rub strip 34 to achieve a precise operational tolerance between the tip 36 and the rub strip 34. If such a tolerance is not achieved, conditions adverse to gas turbine engine 10 efficiency can result, including increased turbulence and internal drag, or flow around the fan 18 rather than through the fan 18. Airflow can even travel upstream around the fan 18, from the fan duct 24 to the atmosphere.

Figure 7:
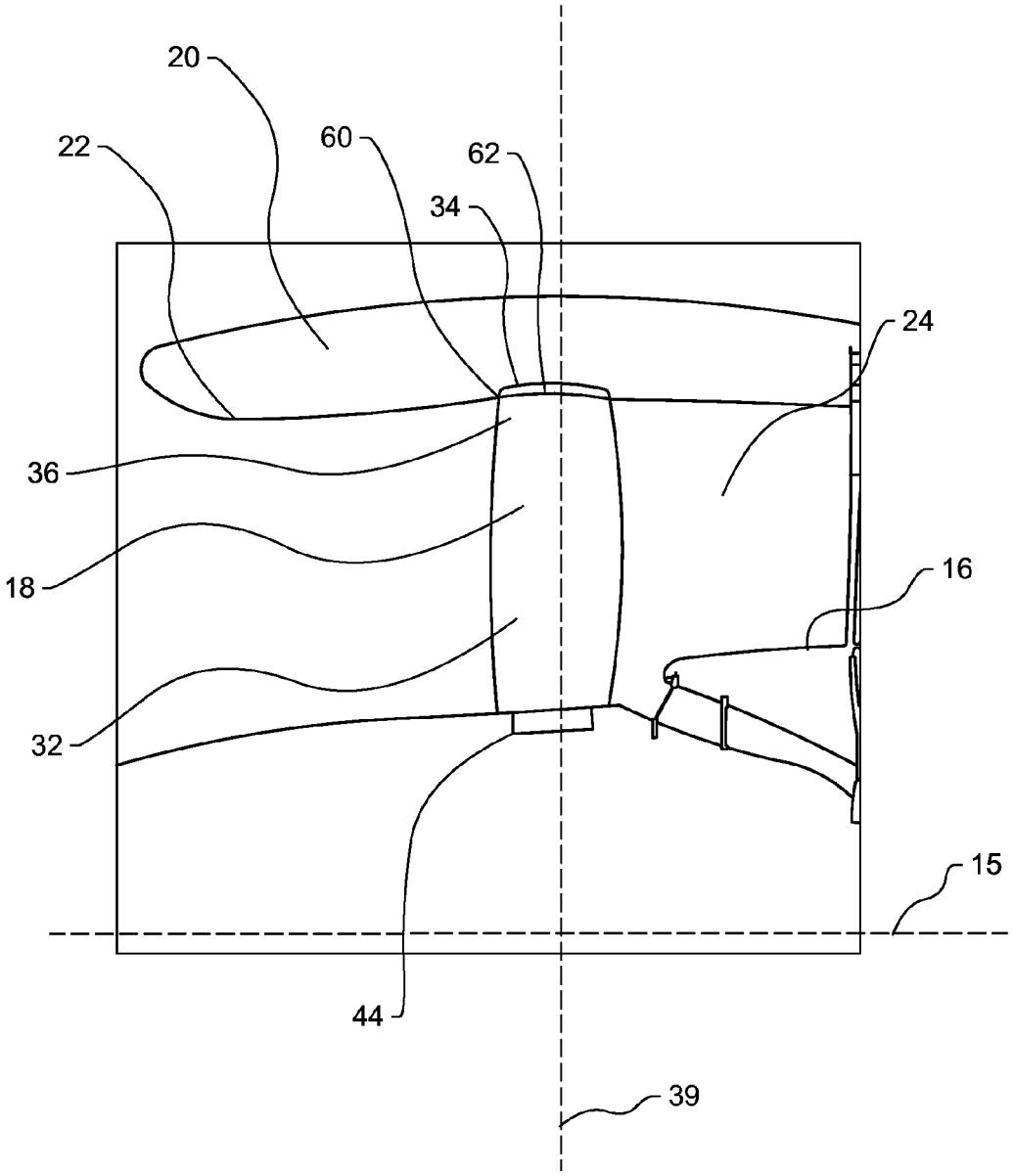
FIG. 7 is a schematic side view of a gas turbine engine with portions of a nacelle broken away to show details of the present disclosure.

The rub strip 34 and tip 36 are spherically shaped using corresponding radii of similar size, an arrangement permitting angular adjustment of the blade 32 relative to the rub strip 34, as best shown in FIG. 7. Such a variable-pitch design enables a single engine to provide multiple propulsion modes, including producing thrust in multiple directions. The blade 32 can be inserted into the blade receiver 44 that may rotate to adjust the blade 32 pitch angle, and the blade receiver 44 may have the ability to alter the blade 32 pitch angle continuously or in step changes. The corresponding spherical shapes can maintain a desired amount of clearance between the blade 32 and the rub strip 34 while allowing a variable-pitch design.

However, the rub strip 34 may have a rub strip leading edge 60 with a smaller inner diameter than that of a rub strip center section 62. Therefore, with prior art systems, it is impossible to insert a blade 32 into a blade receiver 44 axially along the central longitudinal axis 15 as the tip 36 will not clear the rub strip leading edge 60. Further, inserting the blade 32 axially along the central longitudinal axis 15 with prior art systems is impossible due to portions of the fan cowl 22 or nacelle 20. These spatial conflicts between the blade 32 and the rub strip leading edge 60, fan cowl 22 or nacelle 20 may require a more costly and time-consuming blade 32 installation using an axial, constant-radius process. However, the present disclosure greatly improves upon these obstacles by allowing an axial blade 32 installation involving multiple axial radii and a blade 32 translation along the blade axis 39, allowing the blade 32 installation to avoid the aforementioned spatial conflicts. Blade 32 can be inserted through the rub strip leading edge 60 at one radius from the central longitudinal axis 15 and then positionally translate to a second radius, allowing complete axial blade installation without engine 10 or nacelle 20 modifications or disassembly.

Figure 8:
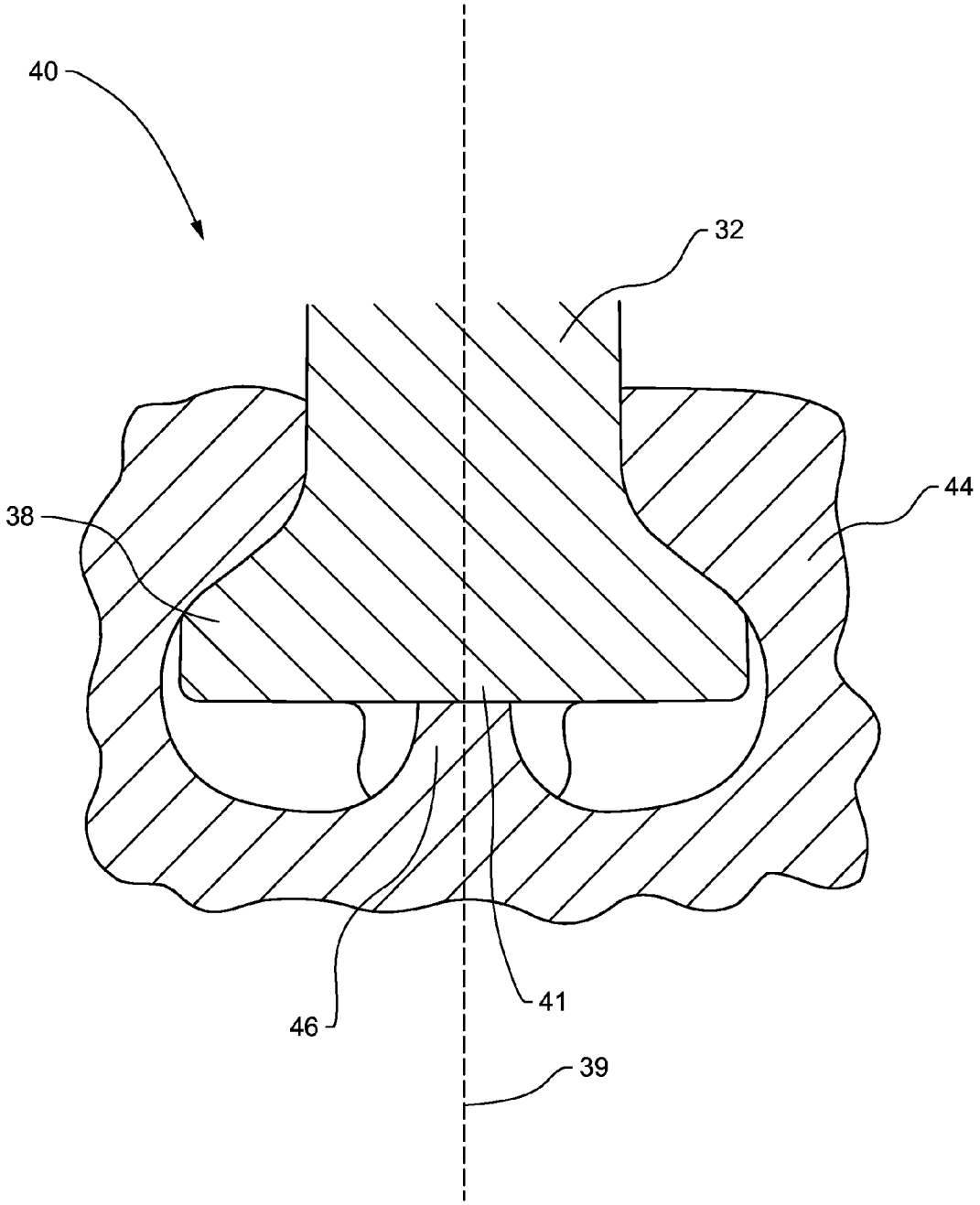
FIG. 8 is a front cross section view of a root and blade receiver showing details of the present disclosure.

The blade 32 can be inserted into the blade receiver 44, as shown in FIG. 8. The blade receiver 44 is shaped to support the blade 32 laterally and along blade axis 39 through corresponding contours of the root 38 and the receiver 44, and through the interaction between the surface 41 and the face 46.

Figure 9:
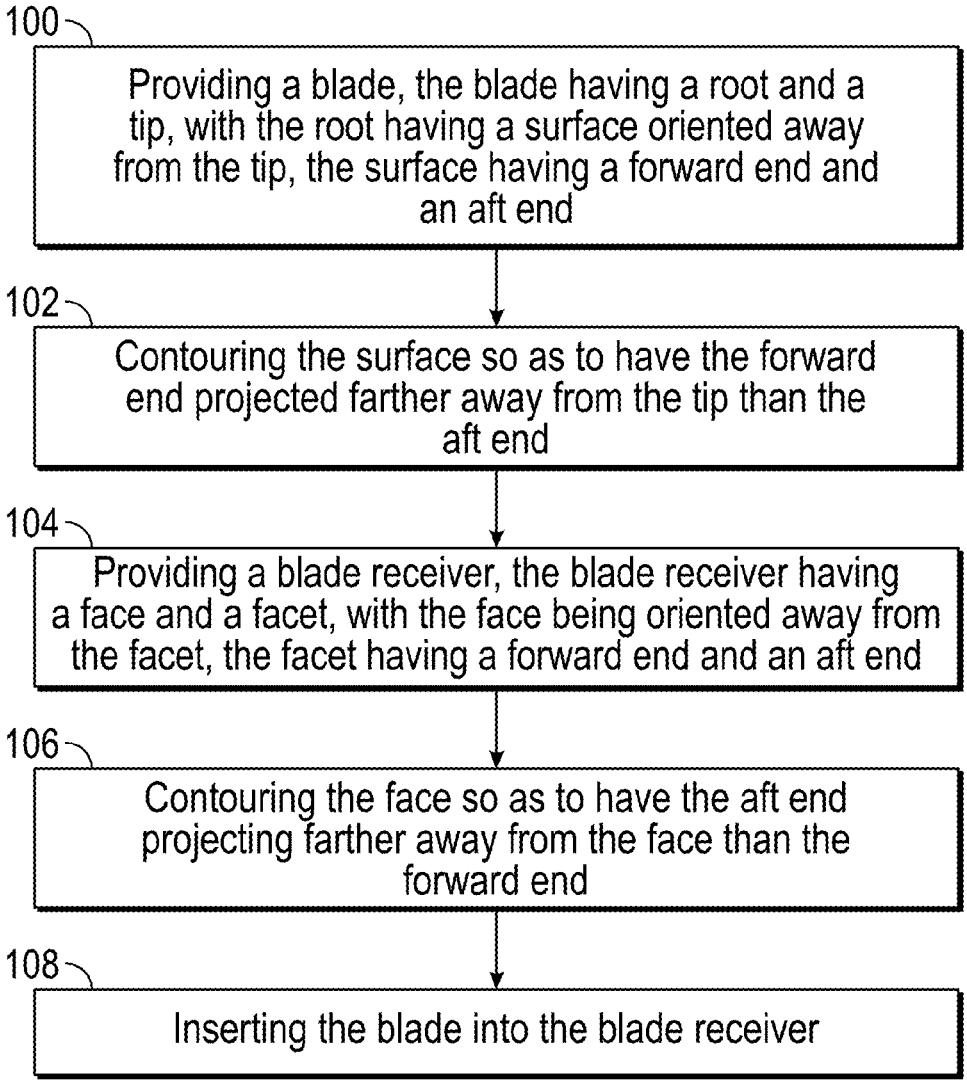
FIG. 9 is a flowchart depicting a sample sequence of steps which may be practiced using the teachings of the present disclosure.

A method of positioning and supporting a blade in a blade receiver in operation can be understood by referencing the flowchart in FIG. 9. The method comprises providing a blade, the blade having a root and a tip, with the root having a surface oriented away from the tip, the surface having a forward end and an aft end 100, contouring the surface so as to have the forward end projecting farther away from the tip than the aft end 102, providing a blade receiver, the blade receiver having a face and a facet, with the face being oriented away from the facet, the face having a forward end and an aft end 104, contouring the face so as to have the aft end projecting farther away from the facet than the forward end 106 and inserting the blade into the blade receiver 108.

INDUSTRIAL APPLICABILITY

Variable-pitch design enables a single gas turbofan engine 10 to provide multiple propulsion modes. The blade 32 can be inserted into the blade receiver 44 that may rotate to adjust the blade 32 angle. The corresponding spherical shapes can maintain a desired amount of clearance between the blade 32 and the rub strip 34 while allowing a variable-pitch design.

However, the rub strip 34 may have a rub strip leading edge 60 with a smaller inner diameter than that of a rub strip center section 62. Further, inserting the blade 32 axially along the central longitudinal axis 15 with prior art systems is impossible due to portions of the fan cowl 22 or nacelle 20. These spatial conflicts between the blade 32 and the rub strip leading edge 60, fan cowl 22 or nacelle 20 may require a more costly and time-consuming blade 32 installation using an axial, constant-radius process.

However, the present disclosure greatly improves upon these obstacles by allowing an axial blade 32 installation involving multiple axial radii and a blade 32 translation along the blade axis 39, allowing the blade 32 installation to avoid the aforementioned spatial conflicts. The blade 32 can be inserted through the rub strip leading edge 60 at one radius from the central longitudinal axis 15 and then positionally translate to a second radius, allowing complete axial blade installation without engine 10 or nacelle 20 modifications or disassembly.

While the present disclosure has shown and described details of exemplary embodiments, it will be understood by one skilled in the art that various changes in detail may be effected therein without departing from the spirit and scope of the disclosure as defined by claims supported by the written description and drawings. Further, where these exemplary embodiments (and other related derivations) are described with reference to a certain number of elements it will be understood that other exemplary embodiments may be practiced utilizing either less than or more than the certain number of elements.

What is claimed is:

1. A blade positioning and support system for a gas turbine engine having a central longitudinal axis and comprising:

a blade having a root and a tip, with the root having a surface oriented away from the tip, the surface having a forward end and an aft end, the forward end projecting farther away from the tip than the aft end; and a blade receiver having a face and a facet, the face being oriented away from the facet, the face having a forward end and an aft end, the aft end projecting farther away from the facet than the forward end when the blade receiver is positioned with the facet turned towards the central longitudinal axis, wherein the blade receiver face has a first portion extending axially from a leading edge of the blade receiver at its forward end and a second portion at its aft end, the second portion being spaced further from the facet than the first portion, the first portion being connected to the second portion by an angled ramp;

wherein the blade root surface has a first surface portion at its forward end and a second surface portion at its aft end, the first surface portion being spaced from the tip further than the second surface portion and being connected to the second surface portion by an angled ramp; and wherein the first surface portion of the blade root surface is received on the first portion of the blade receiver face and the second surface portion of the blade root surface is received on the second portion of the blade receiver face when the blade is installed in the blade receiver.

2. The blade positioning and support system of claim 1, wherein the first portion of the blade receiver face comprises two portions connected by an angled ramp and the first surface portion of the blade root face also comprises two portions connected by an angled ramp.

3. The blade positioning and support system of claim 1, wherein the first portion of the blade receiver face comprises two portions connected by an angled ramp.

4. The blade positioning and support system of claim 1, wherein the blade can be inserted into the blade receiver while passing within a leading edge of a rub strip, the blade receiver having the ability to alter the blade pitch angle continuously, or in step changes, and to provide thrust in multiple directions.

5. The blade positioning and support system of claim 1, wherein the blade receiver includes multiple blade positions along an axis between the tip and the root as the blade is inserted into the blade receiver.

6. The blade positioning and support system of claim 1, wherein the blade receiver supports the blade along an axis between the tip and the root after the blade is inserted into the blade receiver.

7. The blade positioning and support system of claim 1, wherein the blade includes a main blade body section and a root section.

8. The blade positioning and support system of claim 1, wherein the blade receiver includes a main blade receiver body section and a blade receiver section.

9. The blade positioning and support system of claim 4, wherein the tip and rub strip are generally spherically shaped.

10. The blade positioning and support system of claim 1, wherein the blade or blade receiver includes a material having damping properties, the material being anyone of: a polymer, a metal alloy or a ceramic.

11. A gas turbine engine, comprising:

a fan having a plurality of blades, each of the plurality of blades having a root and a tip, with the root having a surface oriented away from the tip, the surface having a forward end and an aft end, the forward end projecting farther away from the tip than the aft end; and a plurality of blade receivers each having a face and a facet, with the face being oriented away from the facet, the face having a forward end and an aft end, the aft end projecting farther away from the facet than the forward end, wherein each of the plurality of blade receivers are positioned with the facet turned towards a central axis of the gas turbine engine, wherein each blade receiver face has a first portion extending axially from a leading edge of the blade receiver at its forward end and a second portion at its aft end, the second portion being spaced further from the facet than the first portion, the first portion being connected to the second portion by an angled ramp;

wherein the surface of each blade root has a first surface portion at its forward end and a second surface portion at its aft end, the first surface portion being spaced from the tip further than the second surface portion and being connected to the second surface portion by an angled ramp; and wherein the first surface portion of each blade root is received on the first portion of one of the blade receiver faces and the second surface portion each blade root is received on the second portion of one of the blade receiver faces when the blade is installed in the blade receiver.

12. The gas turbine engine of claim 11, wherein the first portion of each blade receiver face of the plurality of blade receivers comprises two portions connected by an angled ramp and the first surface portion of the blade root face of each of the plurality of blade roots also comprises two portions connected by an angled ramp.

13. The gas turbine engine of claim 11, wherein the first portion of each blade receiver face of the plurality of blade receivers comprises two portions connected by an angled ramp.

14. The gas turbine engine of claim 11, wherein each of the plurality of blades can be inserted into a respective one of the plurality of blade receivers while passing within a leading edge of a rub strip, and each blade receiver of the plurality of blade receivers having the ability to alter a blade pitch angle continuously, or in step changes of the respective one of the plurality of blades as they are inserted into a respective one of the plurality of blade receivers while passing within the leading edge of the rub strip, and to provide thrust in multiple directions to the respective one of the plurality of blades as they are inserted into a respective one of the plurality of blade receivers while passing within the leading edge of the rub strip.

15. The gas turbine engine of claim 11, wherein each of the plurality of blade receivers includes multiple blade positions along an axis between the tip and the root as a respective one of the plurality of blades is inserted into a respective one of the plurality of blade receivers.

16. The gas turbine engine of claim 11, wherein each of the plurality of blade receivers supports a respective one of the plurality of blades along an axis between the tip and the root after the respective one of the plurality of blades is inserted into a respective one of the plurality of blade receivers.

17. The gas turbine engine of claim 11, wherein each of the plurality of blades includes a main blade body section and a root section.

18. The gas turbine engine of claim 11, wherein each of the plurality of blade receivers includes a main blade receiver body section and a blade receiver section.

19. The gas turbine engine of claim 14, wherein the tip and rub strip are generally spherically shaped.

20. A method of positioning and supporting a blade in a blade receiver comprising:

inserting the blade into the blade receiver such that during insertion, an angled ramp of the blade receiver and an angled ramp of the blade cause the blade to positionally translate in the direction of a tip of the blade along a blade axis, wherein the angled ramp of the blade contacts a first portion of the blade receiver extending axially from a leading edge of the blade receiver at its forward end and wherein the angled ramp of the blade is located on a root of the blade, the root having a surface oriented away from the tip of the blade, the surface of the root having a forward end and an aft end, the forward end of the surface of the root projecting farther away from the tip than the aft end of the surface of the root;

wherein the blade receiver has a face and a facet, the face being oriented away from the facet, the face having a forward end and an aft end, the aft end of the face projecting farther away from the facet than the forward end of the face when the blade receiver is positioned with the facet turned towards a central longitudinal axis of the blade receiver, wherein the blade receiver face includes the first portion of the blade receiver and a second portion located at an aft end of the of the blade receiver, the second portion of the blade receiver being spaced further from the facet than the first portion of the blade receiver, the first portion of the blade receiver being connected to the second portion of the blade receiver by the angled ramp of the blade receiver; and wherein the angled ramp of the blade root is received on the first portion of the blade receiver and the aft end of the surface of the blade is received on the second portion of the blade receiver face when the blade is inserted into the blade receiver.

* * * * *